US011873144B2

(12) United States Patent
Centofanti et al.

(10) Patent No.: US 11,873,144 B2
(45) Date of Patent: Jan. 16, 2024

(54) PACKAGING FOR HOLDING BOTTLES

(71) Applicant: 3.7 S.R.L., Pescara (IT)

(72) Inventors: Antonio Centofanti, Tollo (IT); Marco Di Ghionno, Tollo (IT)

(73) Assignee: 3.7 S.R.L., Pescara (IT)

( * ) Notice: Subject to any disclaimer, the term of this patent is extended or adjusted under 35 U.S.C. 154(b) by 0 days.

(21) Appl. No.: 17/775,550

(22) PCT Filed: Nov. 13, 2020

(86) PCT No.: PCT/IB2020/060696
§ 371 (c)(1),
(2) Date: May 9, 2022

(87) PCT Pub. No.: WO2021/094997
PCT Pub. Date: May 20, 2021

(65) Prior Publication Data

US 2022/0396391 A1 Dec. 15, 2022

(30) Foreign Application Priority Data

Nov. 13, 2019 (IT) ..... 102019000021030

(51) Int. Cl.
*B65D 5/50* (2006.01)

(52) U.S. Cl.
CPC ..... *B65D 5/5061* (2013.01); *B65D 5/5069* (2013.01)

(58) Field of Classification Search
CPC ..... B65D 5/5069; B65D 5/5061
USPC ..... 206/590
See application file for complete search history.

(56) References Cited

U.S. PATENT DOCUMENTS 1,585,498 A * 5/1926 Kenyon ..... B65D 5/5061 206/472
1,803,028 A * 4/1931 Menten ..... B65D 5/5021 206/485
1,930,235 A * 10/1933 Fox ..... B65D 5/48002 206/427
2,353,376 A * 7/1944 Vatter ..... B65D 5/5038 206/418
2,377,602 A * 6/1945 Belden ..... B65D 85/42 206/418
2,377,603 A * 6/1945 Belden ..... B65D 5/5061 206/418

(Continued)

FOREIGN PATENT DOCUMENTS

CN 103318561 A 9/2013
FR 1511456 A 1/1968

OTHER PUBLICATIONS

International Search Report for PCT/IB2020/060696 dated Feb. 26, 2021.

*Primary Examiner* — Ernesto A Grano
(74) *Attorney, Agent, or Firm* — LOZA & LOZA, LLP

(57) ABSTRACT

A package for carrying at least one bottle, comprises at least one container suitable for housing a support in turn configured to hold at least one bottle, wherein the support comprises a base portion, a top portion and a central portion wherein the base portion and the top portion are each configured as a box-like body to accommodate and retain respective portions of the at least one bottle and wherein the central portion comprises one or more inclined planes configured to house and hold a central portion of the at least one bottle.

17 Claims, 7 Drawing Sheets

(56) References Cited

U.S. PATENT DOCUMENTS

| | | | | | |
|---|---|---|---|---|---|
| 2,458,737 | A * | 1/1949 | Salkowitz | B65D 77/0486 | 229/5.5 |
| 3,289,829 | A * | 12/1966 | Donahue | B65D 85/44 | 206/592 |
| 3,567,103 | A * | 3/1971 | Seifert | B65D 5/5057 | 206/588 |
| 3,868,140 | A * | 2/1975 | Gordon | B65D 71/004 | 206/139 |
| 4,155,502 | A * | 5/1979 | Forte | B65D 71/48 | 294/146 |
| 5,213,215 | A * | 5/1993 | Prevot | B65D 5/509 | 206/592 |
| 5,392,919 | A * | 2/1995 | Passamoni | B65D 73/0085 | 206/576 |
| 5,624,032 | A * | 4/1997 | Yucknut | B65D 5/5059 | 229/120.32 |
| 5,730,289 | A * | 3/1998 | Cappels | B65D 5/5045 | 229/89 |
| 5,813,523 | A * | 9/1998 | Gnadt | B65D 5/5061 | 206/778 |
| 6,474,473 | B2 * | 11/2002 | Wong | B65D 5/5021 | 206/427 |
| 6,702,115 | B1 * | 3/2004 | Roper | B65D 5/5061 | 206/427 |
| 7,311,201 | B2 * | 12/2007 | Lo | B65D 15/04 | 206/427 |
| 8,230,997 | B1 * | 7/2012 | McWilliams | B65D 5/5038 | 206/139 |
| 9,248,933 | B2 * | 2/2016 | Spivey, Sr. | B65D 5/4204 | |
| 10,179,692 | B2 * | 1/2019 | Tremblay | B65D 85/30 | |
| 2020/0108971 | A1 * | 4/2020 | McCarthy | B65D 5/5061 | |
| 2020/0198832 | A1 * | 6/2020 | McCarthy | B65D 5/5061 | |

* cited by examiner

PACKAGING FOR HOLDING BOTTLES

The present invention relates to packaging for fragile containers such as a bottle or similar glass container.

In particular, the packaging is designed to safely handle, store, transport and display these fragile containers, preventing them from being damaged.

In the following, reference will mainly be made to a packaging for at least one glass container such as a bottle (for example for wine, liqueurs, water, oil, etc.). However, it should be borne in mind that the packaging according to the invention can also be configured to contain a different glass container such as a bottle or a flask, for example for perfume or more, in general, a liquid substance.

Packaging for the transport of bottles or similar glass containers are known which have specific characteristics, depending on the transport for which they are intended, so-called secondary packaging or tertiary packaging. For example, packages are known which are configured as a plastic or paper bag provided with suitable handles, cardboard or wooden boxes, possibly filled with material suitable for protecting the container itself.

As for the bags, in general, they are configured for the transport of a single bottle and do not provide adequate protection against impacts.

With reference to packaging in the form of boxes, and in particular to those made of cardboard, they are obtained starting from a punched or sheared sheet and suitably folded and glued to define a container inside which one or more bottles to be transported can be stored, depending on the size of the packaging.

Such a packaging requires the addition of stabilizing elements inside and of filling material, such as polystyrene, expanded polystyrene, inserts of printed or pressed paper, in order to cushion any shocks to which the packaging may be subjected during transport, avoiding damage to the bottle or bottles inside.

The use of stabilizing elements complicates the assembly of the packaging as it requires the correct positioning and connection of individual stabilizing elements to ensure specific portions of the container to the inner walls of the packaging.

In addition, the use of stabilizers allows, in general, to block the bottle only in some points without thus obtaining a total anchorage between the bottle and the packaging.

The use of filling material also determines an increase in the time needed to form the packaging as well as the production of waste material with a consequent impact in terms of environmental pollution.

Further tubular-shaped packaging are also known inside which a single bottle can be housed. Such a type of tubular packaging is not free from drawbacks with reference to the fact that there is a continuous movement between the bottle and the packaging, such that a rubbing occurs between the wall of the packaging and the bottle with possible damage to any labels or decorations applied externally to the bottle. Furthermore, such packaging allows the transport of a single bottle, thus limiting its use.

It should also be noted that the packaging indicated above is unsuitable for displaying the product, being mainly configured to define protection for transport.

Furthermore, such packages are not very flexible in the sense that they do not allow bottles of different formats to be contained, requiring each time the realization of specific packaging according to the dimensions of the individual bottles.

In the packaging field, there is a need to have packaging for fragile containers, such as glass bottles, which allows them to perform the protective function for the container as well as the display function, as part of a safe solution capable of ensuring the integrity of the container itself.

Document no. GB 2279065 describes a packaging for the transport of four bottles which in addition to the transport function performs the above-mentioned display function. However, this packaging does not allow to protect the bottles from any knocks during transport.

International application no. WO 2014/114839 describes a packaging for the transport of two bottles which, similarly to the solution described in the previous document GB 2279065, allows the bottles to be exposed during their transport without, however, guaranteeing optimal protection from any impact.

The purpose of the present invention is, therefore, to allow in a simple, reliable, efficient, and economical way to create a packaging that ensures optimal protection during transport of the glass container as well as during the display of the container itself.

Another object of the present invention is to provide packaging for fragile containers, such as glass bottles, which is simple and easy to assemble and use, as part of a solution capable of reducing the costs for manufacturing the packaging itself.

A further object of the present invention is to provide a packaging for fragile containers which is of flexible use, being able to be adaptable to the dimensions of various glass containers which differ from each other in a predetermined range of values.

Specific object of the present invention is a packaging for the transport of at least one bottle, comprising at least one container configured to define a compartment wherein to house and hold a support in turn configured to hold at least one bottle, wherein the support comprises a portion of base, a top portion and a central connecting portion between the base portion and the top portion, wherein the base portion and the top portion are each configured as a box-like body for receiving and retaining respective portions of the at least a bottle and wherein the central portion comprises at least a first inclined plane and at least a second inclined plane connected to each other and configured to house and hold a central portion of the at least one bottle.

According to another aspect of the present invention, the base portion can comprise a base, a first wall which extends orthogonally from the base, a second wall which extends orthogonally from the base, on the opposite side to that of the first wall, an element of plane holding which extends from the second wall, on the side opposite to that connected to the base, wherein the flat retaining element defines at least one through opening which can be engaged by a bottom portion of the at least one bottle.

According to a further aspect of the present invention, the top portion can comprise at least a first top wall, a flat top projecting orthogonally from the first top wall, a second top wall projecting orthogonally from the flat top on the side opposite to that of the first top wall and a top flat element which extends transversely from the second top wall on the opposite side to that of the flat top, wherein the flat top element defines at least one through hole configured to be engaged by a portion head of at least one bottle.

According to an additional aspect of the present invention, the support can comprise a first lower reinforcement element that starts from one side of the first inclined plane and is configured to be selectively connected with the base portion, a first upper reinforcement element that starts on one side of the second inclined plane and is configured to be selectively connected with the top portion, wherein the first lower reinforcement element and the first upper reinforcement element are both positioned along a same side of the support.

According to another aspect of the present invention, the support can comprise a second lower reinforcement element that starts from one side of the first inclined plane, opposite to that from which the first lower reinforcement element departs and is configured to be selectively connected with the top portion, a second upper reinforcement element which departs from one side of the second inclined plane, opposite to that from which the first upper reinforcement element departs, and is configured to be selectively connected with the top portion.

According to a further aspect of the present invention, the first lower reinforcement element defines, in correspondence with its base portion, a first seat that can be removably engaged from a first protrusion which extends laterally from the first side of the base portion of the support, optionally wherein the first upper reinforcement element defines a second seat which can be engaged by a second protrusion which extends laterally from the first side of the top portion of the support.

According to an additional aspect of the present invention, the second lower reinforcement element can delimit, in correspondence with its base portion, a respective first opening which can be removably engaged from a respective first protrusion which extends laterally from a second side of the base portion, optionally wherein the second upper reinforcement element defines a respective second seat engageable by a respective second protrusion which extends laterally from the second side of the top portion of the support.

According to another aspect of the present invention, the support comprises bottom spacer elements that radiate orthogonally from the base, from opposite sides, at the first wall and the second wall and are configured to abut against a bottom portion of the container when the support is inserted into the container, keeping the support raised from the bottom portion of the container.

According to a further aspect of the present invention, the support comprises top spacer elements, in correspondence with the top portion which protrude orthogonally from the flat top and are configured to distance the top portion from a top portion of the container compartment, with the holder inserted in the container.

According to an additional aspect of the present invention, the support can have retention elements configured as shaped tabs which protrude from the first wall, along a direction normal to the base and engage respective openings made passing through the retaining plane element and the first inclined plane to hold the flat retaining element in place.

According to another aspect of the present invention, the support may comprise further retaining elements configured to hold the flat top element in position, wherein the further retaining elements comprise further shaped tabs extending from the second top wall, in direction normal to the flat top, and engage respective openings made passing through the top flat element and one of the first inclined plane or the second inclined plane which is connected to the flat top element.

According to a further aspect of the present invention, the package can comprise at least one grip handle which extends from a top portion of the closure lid through a through opening formed in the closure lid, wherein the at least one handle is configured to selectively assuming a retracted position, wherein the at least one handle is retracted inside the closure lid or an extracted position wherein the at least one handle extends from a top portion of the closure lid.

According to an additional aspect of the present invention, the packaging can comprise at least one dampening device comprising at least one support tab provided at the base portion in a spaced position with respect to the base, wherein the at least one support tab is foldable towards the inside of the base portion of the holder to act as a deformable support for the at least one bottle.

The advantages provided by the packaging according to the invention are evident.

The packaging according to the invention, in fact, allows to overcome the drawbacks disclosed in relation to the state of the art with reference to the possibility of guaranteeing a high protection for the at least one bottle even within the context of an easy-to-use solution, able to firmly hold the at least one bottle inside of it, preventing it from being damaged during transport.

The present invention will now be described, for illustrative but not limitative purposes, according to its preferred embodiments, with particular reference to the Figures of the attached drawings, wherein.

Figure 9:
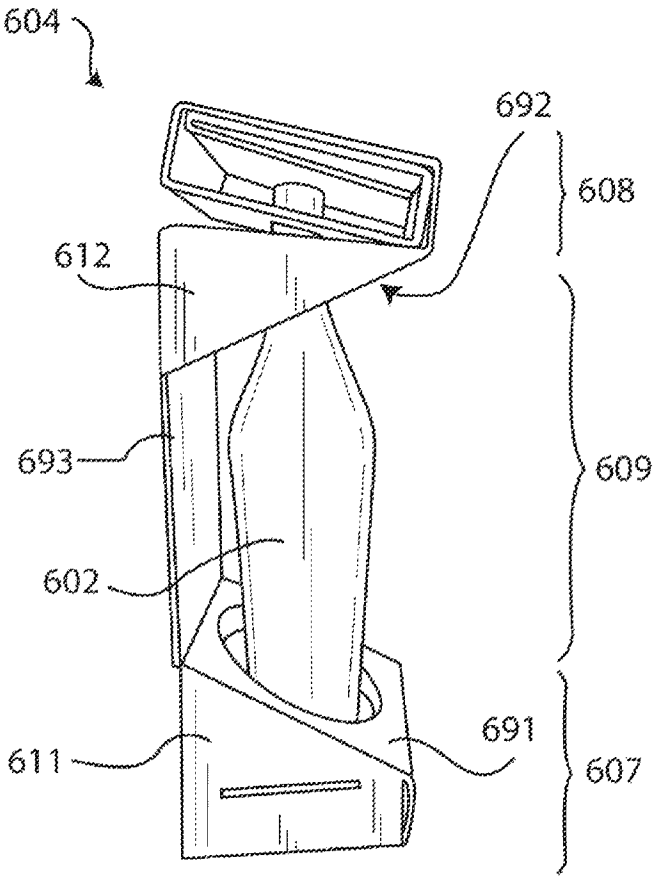
Figure 8:
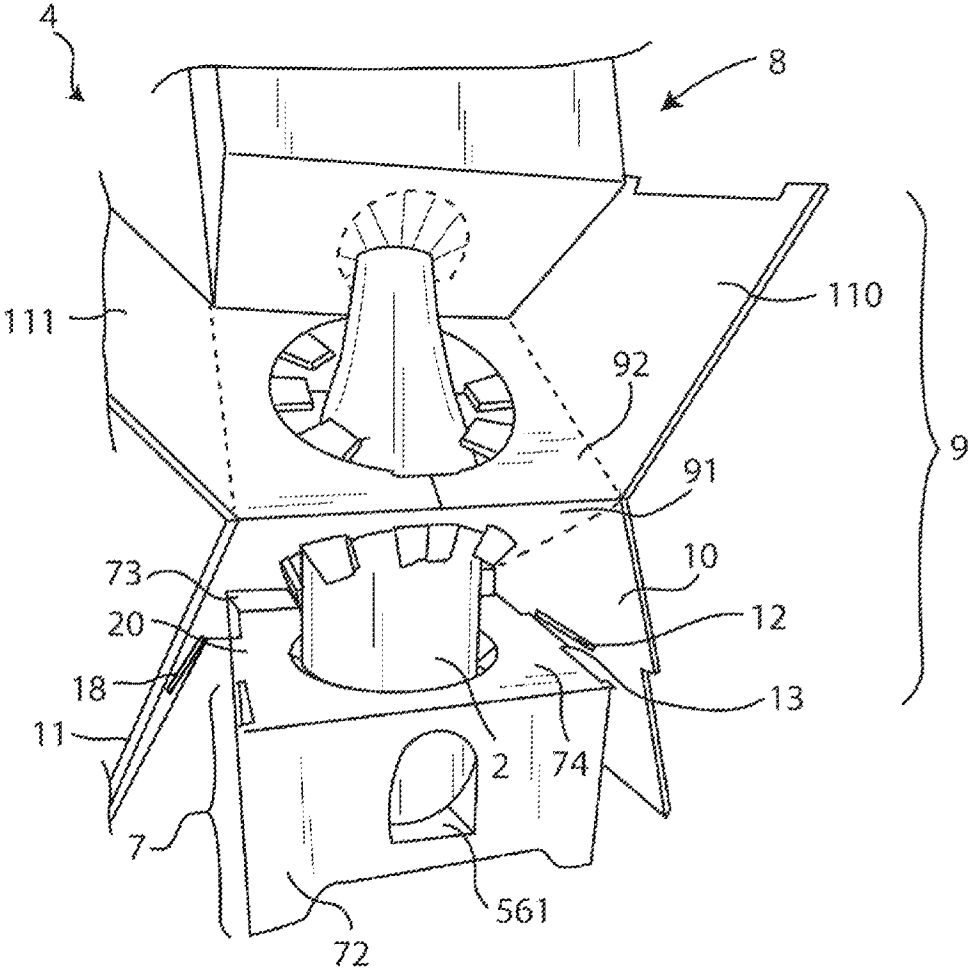
Figure 10:
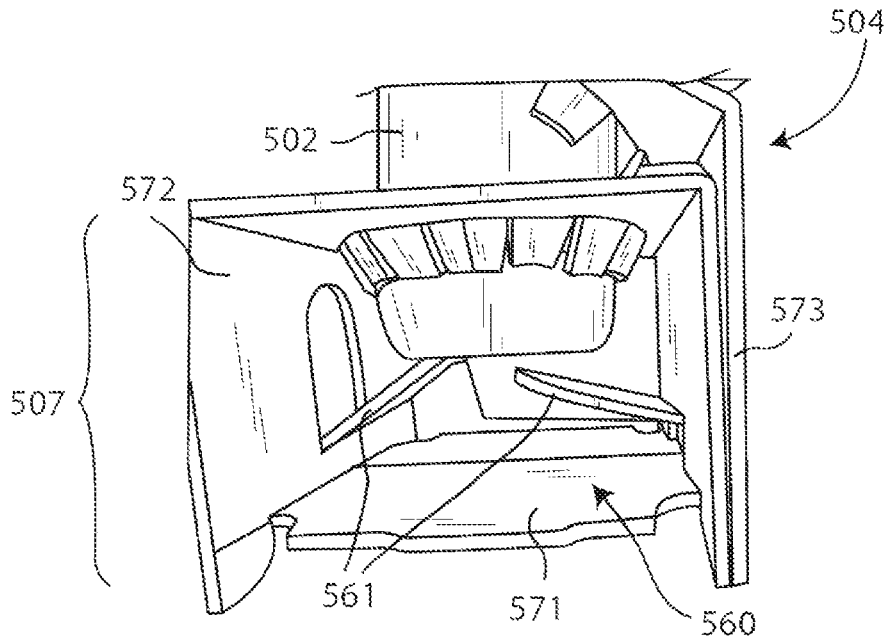
Figure 11:
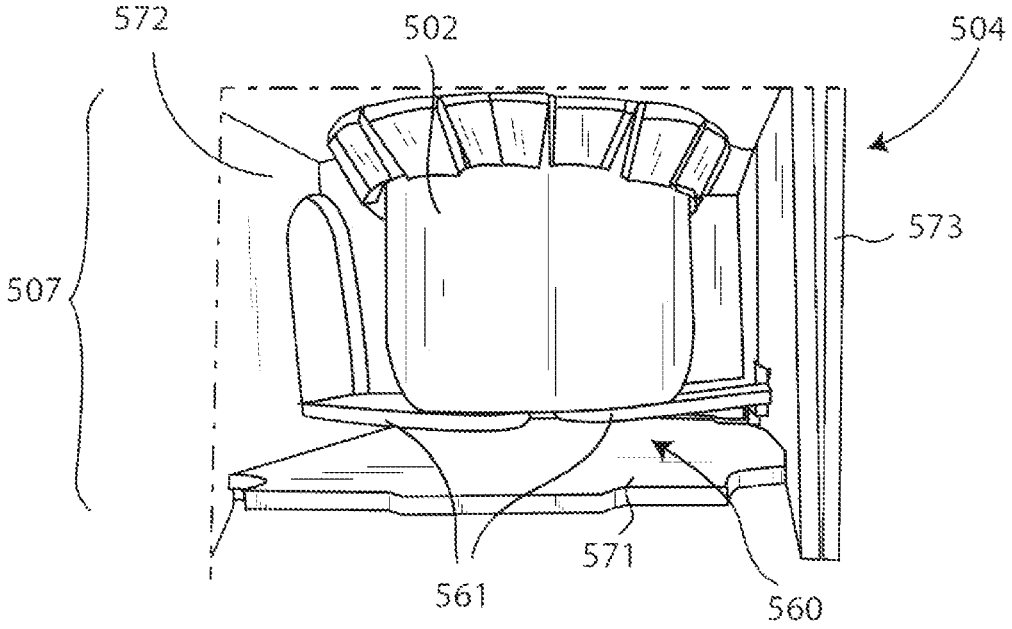
Figure 12:
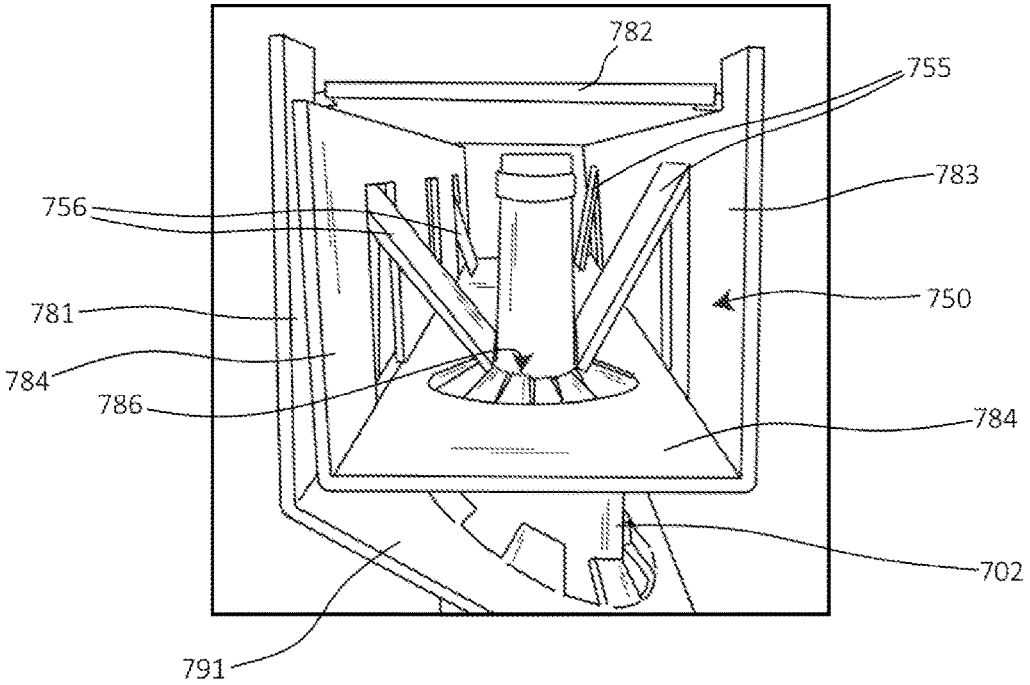
Figure 13:
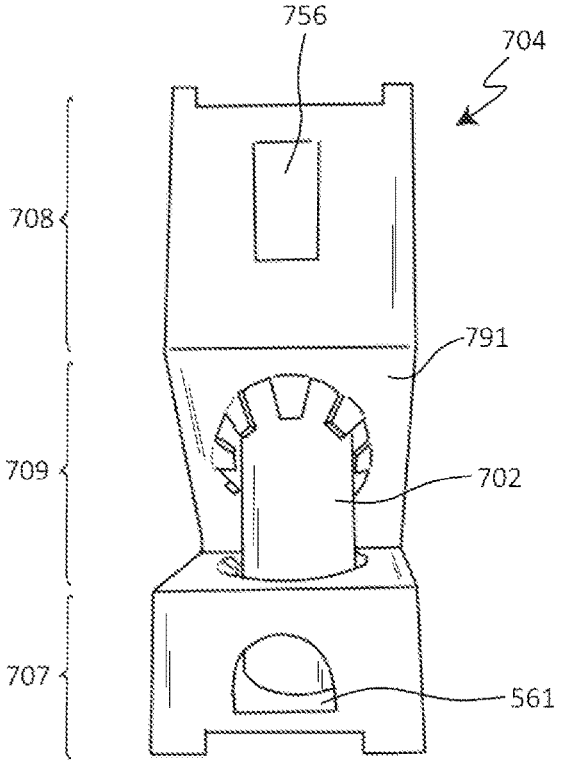
Figure 14:
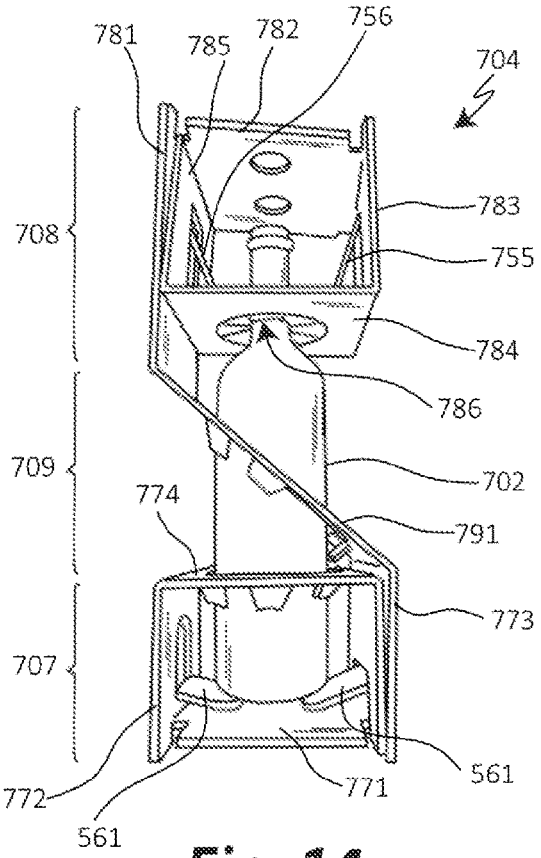

FIGS. 4 to 7 each show a respective further version of the packaging according to the invention;

FIG. 8 shows a front perspective view of some details of the packaging according to the invention;

FIG. 9 shows a side view of a further version of the packaging according to the invention;

FIGS. 10 and 11 show detailed side views of some components of the packaging according to the present invention, FIG. 12 shows a detailed side view of some components of the packaging according to the present invention;

FIGS. 13 and 14 show views from different angles of a further embodiment of the packaging according to the present invention, in particular a rear view (FIG. 13) and a side view (FIG. 14).

In the Figures identical reference numbers will be used for similar elements.

In the following description, the directional terminology, such as "right", "left", "front", "rear", "base", "top", "upper", "lower", "lateral", etc., is used with reference to the Figures of the attached drawings for illustrative and non-limiting purposes.

Figure 1:
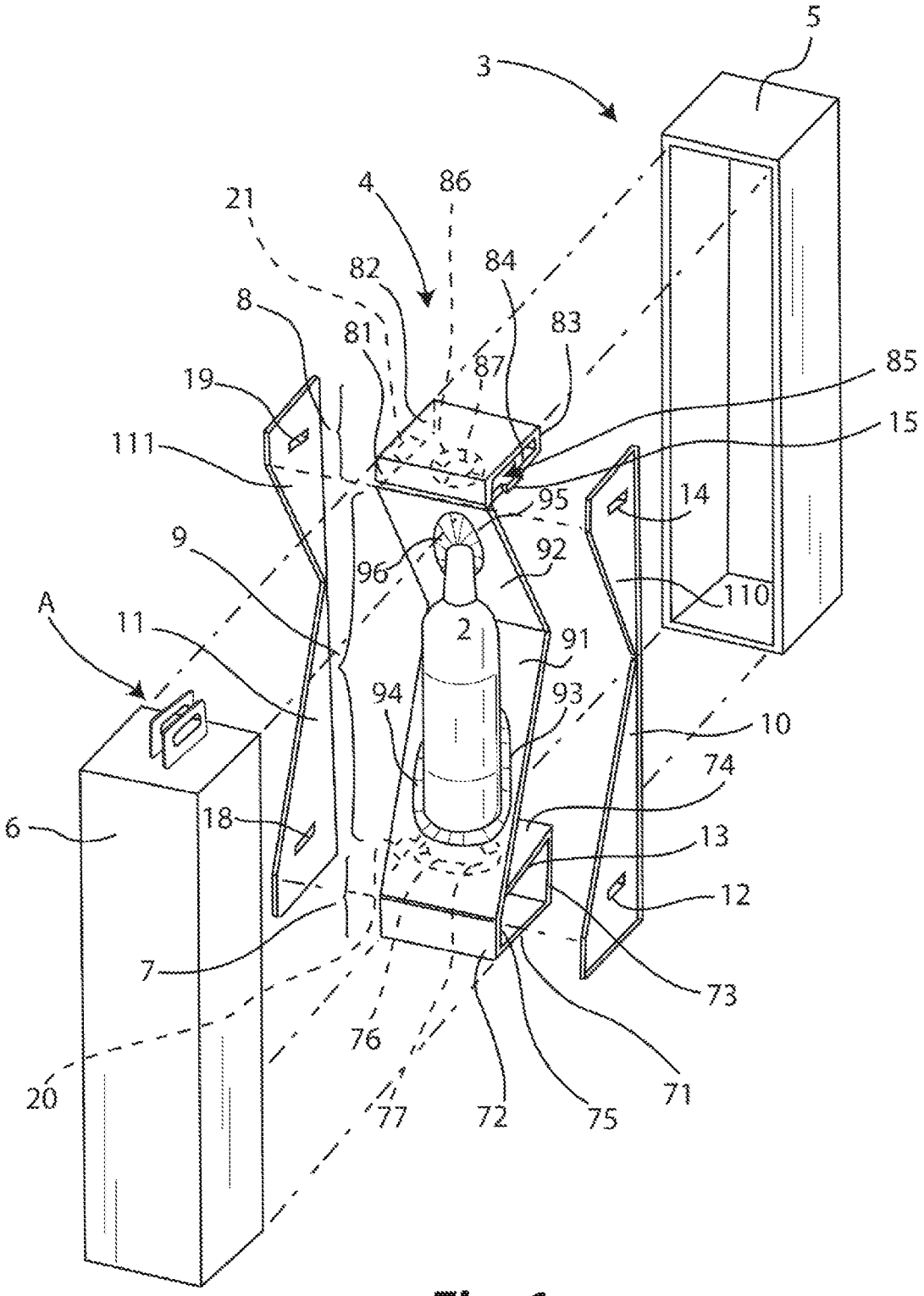
FIG. 1 shows an exploded perspective view of a packaging according to the invention.

With reference to FIG. 1, it can be observed that a preferred embodiment of the packaging according to the invention is wholly indicated with 1.

As mentioned, in the following description reference will be made to a packaging 1 for at least one fragile container such as a glass bottle 2, for example a bottle for wine, although it is understood that the invention can also be used to pack a fragile container such as a small bottle or similar glass container.

Packaging 1 includes at least one container 3, configured to define a compartment wherein to house a support 4 in turn configured to hold at least one bottle 2.

Figure 3:
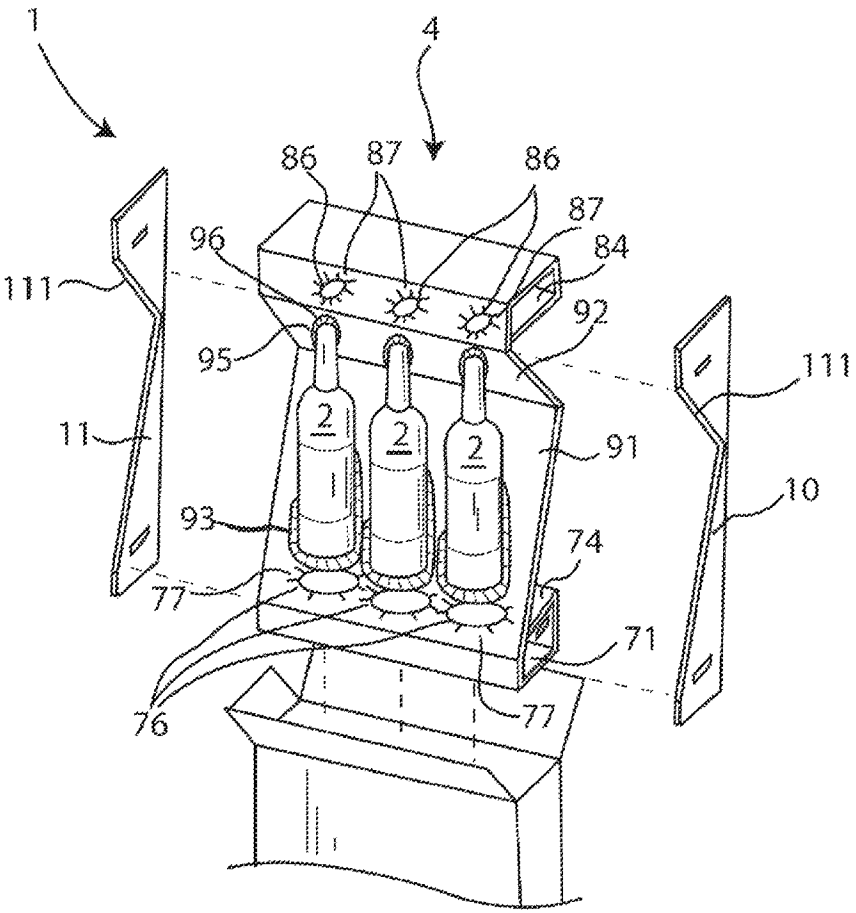
FIG. 3 shows an exploded perspective view of a further version of the packaging according to the invention.
Figure 2:
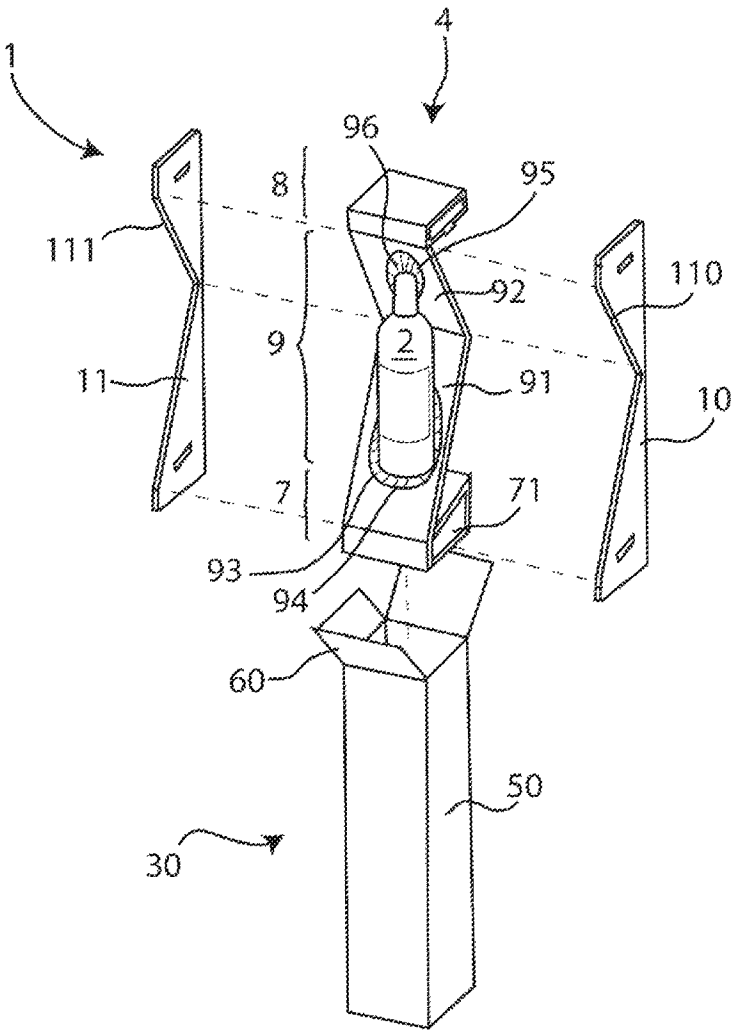
FIG. 2 shows an exploded perspective view of a further version of the packaging of FIG. 1.

With reference to the attached FIGS. 1 and 2, a package 1 configured to contain a single bottle 2 is illustrated, although it is understood that further embodiments are possible to contain a greater number of bottles 2 (see by way of example FIG. 3 wherein the packaging 1 and the relative support 4 are configured to contain three bottles 2 in a position side by side).

The container 3 has a parallelepiped shape and delimits inside a housing compartment for the support 4 and at least one bottle 2 retained by the latter.

With reference to the embodiment illustrated in the attached FIG. 1, the container 3 comprises a containment body 5 to which a closing lid 6 can be associated.

In fact, the containment body 5 and the closing lid 6 are made as two complementary half bodies and can be mutually connected, in a removable way, to selectively delimit the housing compartment for the support 4.

The container 3 can be made of semi-rigid material, such as cardboard or a possibly recycled plastic material.

According to a further embodiment illustrated in the attached FIG. 2, the package 1 comprises a container 30 in turn comprising a containment body 50 which delimits a compartment open at the top and at least one closure lid 60 connected to a top portion of the body of containment 50. The closing lid 60 can be rotated between a closed position, wherein it closes the compartment for housing the support 4, and an opening position wherein it frees a top opening for accessing the housing compartment.

It is understood that instead of a single closing lid 60, the container 30 can comprise a plurality of foldable flaps so as to define a closing lid, according to methods known in the field.

According to an aspect of the present invention, it is highlighted that the container 3, 30 comprises at least one handle grip A which extends from the top of the closing lid 6, 60 (see for example FIG. 1, wherein two handles A are shown in position side by side).

The at least one handle A provides a gripping portion for lifting and transporting the packaging 1.

It is highlighted how the at least one handle A extends through an opening, not shown in detail, made passing through the closing cover 6, 60 to allow, selectively, the positioning of the handle A in an extracted or use configuration, wherein the at least one handle A extends from the top of the closing lid 6, 60 or in a retracted or non-use position, wherein the at least one handle A is retracted inside the closing lid 6, 60.

Preferably, the at least one handle A has a reduced thickness and, therefore, if not used and arranged retracted inside the closing lid 6, 60 it can be easily placed inside the same so as not to interfere with the containment body. 5, 50 and then allow the packaging to be closed 1.

Returning to the embodiment illustrated in the attached FIG. 1, the support 4 comprises a base portion, indicated as a whole with 7, a top portion, indicated as a whole with 8, and a central portion, indicated as a whole with 9, which mutually connects the base portion 7 and the top portion 8 to each other.

The base portion 7 is configured to receive, retain and support the bottom of at least one bottle 2 retained in the support 4, according to methods which will be better described hereinafter.

Similarly, the top portion 8 is configured to securely accommodate and hold the top of at least one bottle 2 inside the support 4 while the central portion 9 is configured to firmly hold the central portion of at least one bottle 2.

It should be noted that the base portion 7, the top portion 8 and the central portion 9 are configured to be coupled, by means of a shape coupling, with respective portions of the compartment delimited in the container 3.

In fact, the container 3 firmly holds the support 4 which, in turn, firmly holds the at least one bottle 2.

Preferably, the support 4 is made starting from a sheet of semi-rigid material, for example from shaped cardboard cut by punching or shearing or cutting, a recycled or plastic material or a composite material in such a way that the base portion 7, the top portion 8 and the central portion 9 are mutually connected to define a single body.

The base portion 7 has a box-like conformation delimited between a base 71, a first wall 72 or front wall, which extends orthogonally from the base 71, a second wall 73 or rear wall which extends orthogonally from the base 71, on the opposite side with respect to the first wall 72. Optionally, the base portion 7 can comprise a flat or abutment retaining element 74 which extends from the second wall 73, on the opposite side to that connected to the base 71.

The base portion 7, if it includes a retaining element 74, may comprise a third wall 75 which protrudes orthogonally from the retaining element 74 itself, on the opposite side to that of the second wall 73 (see FIG. 1).

In fact, the base portion 7 is obtained by bending the first wall 72 and the second wall 73 relatively to each other, by 90° or substantially by 90° with respect to the base 71, so as to define a "U"-shaped element therefore, if present, the retaining element 74 with respect to the second wall 73, orienting it parallel or substantially parallel with respect to the base 71, and bending the third wall 75, if present, with respect to the retaining element 74 so as to define a box-like element.

The base 71, the first wall 72, the second wall 73, the flat retaining element 74 and the third wall 75, if present, are therefore made by folding respective portions of the sheet from which the support 4 is made, resulting in a single body.

The flat retaining element 74 is spaced from the base 71 by a distance equal to the size of the first wall 72 and the second wall 73 along the normal direction to the base 71.

In fact, in the case wherein the first wall 72 and the second wall 73 have the same extension in the direction normal to the base 71, the flat retaining element 74 is orientable parallel to the base 71 while in the case in which the first wall 72 is the second wall 73 has different heights, i.e. extensions along the direction orthogonal to the base 71, consequently the flat retaining element 74 is inclined.

The direction of inclination of the flat retaining element 74 is defined by the extension of the first wall 72 and the second wall 73 along the direction orthogonal to the base 71, as well as by the extension of the third wall 75 along the direction normal to the base 71.

The third wall 75, if present, acts as an abutment for the flat retaining element 74 relative to the base 71, so as to be able to lock the flat retaining element 74 in position. By way of example, the third wall 75 can be glued or bonded by adhesive tape against an internal surface, in use, of the first wall 72. As an alternative to gluing or fixing by means of adhesive tape, the base portion 7 can comprise removable connection, not shown in detail in the attached Figures, comprising at least one tab that departs from the third wall 75 and is configured to engage by interlocking or form coupling at least one respective opening made along the first wall 72 or, if desired, along the base 71, thus locking the flat retaining element 74 in position.

Alternatively, if the base portion 7 does not comprise the third wall 75, the removable connecting members comprise at least one tab which protrudes from the flat retaining element 74 and is configured to engage by interlocking or form coupling at least one respective opening made along the first wall 72.

The flat retaining element 74 has at least one through opening 76 shaped to house the bottom of at least one bottle 2.

The flat retaining element 74 has a plurality of tabs 77 which protrude radially from the edge of the at least one through opening 76.

The tabs 77 are movable independently of each other and act as a retaining element for the bottom portion of the at least one bottle 2 engaged in the base portion 7 of the support 4.

In fact, it is pointed out that following the insertion of a bottle 2 in the at least one through opening 76 the tabs 77 are deflected towards the base 71, firmly abutting against the bottom portion of the bottle 2, holding it in engagement through the at least one through opening 76.

In fact, the tabs 77 act as a support collar and selectively adjust the width of the at least one through opening 76, adapting it to the circumference or, more generally, to the external dimension of the bottle 2 within a predetermined range of values.

The central portion 9 comprises one or more inclined planes configured to act as further retaining elements for the at least one bottle 2 when engaged in the support 4.

With reference to the embodiment illustrated in the attached FIG. 1, the central portion comprises or consists of at least one first inclined plane 91 and at least one second inclined plane 92 connected together.

The at least one first inclined plane 91 extends from the base portion 7, to which it is connected, and extends along an inclined direction with respect to the normal to the base 71.

According to a preferred embodiment, the at least one first inclined plane 91 protrudes from the first wall 72, on the opposite side of the latter with respect to the one connected to the base 71.

According to an alternative embodiment, the at least one first inclined plane 91 protrudes from the second wall 73, on the opposite side to that connected to the base 71. In practice, according to this version, the at least one first inclined plane has an inclination opposite to that illustrated in the attached FIGS. 1-3. The at least one first inclined plane 91 defines at least a first opening 93 of ellipsoidal, circular or similar shape, which extends passing through the at least one inclined first plane 91 itself. The at least one first opening 93 is configured to be engaged by at least one bottle 2 (see FIGS. 1 to 3).

According to a preferred embodiment, the at least one first inclined plane 91 comprises first tabs 94 which extend in a radial direction from the at least one first opening 93 and define a further retaining collar for at least one bottle 2 in the support 4.

The function of the first tabs 94 is the same as that described in relation to the tabs 77 of the base portion 7, to which reference should be made.

The at least one second inclined plane 92 defines at least a second opening 95 with an ellipsoidal, circular or similar shape, which extends passing through the at least one second inclined plane 92 itself. The at least one second opening 95 is configured to be engaged by at least one respective bottle 2.

Similarly to what is described in relation to the first inclined plane 91, the at least one second inclined plane 92 comprises second tabs 96 which protrude radially from the at least one second opening 95, for the same purposes described above in relation to the tabs 77.

In fact, in the support element 4, the tabs 77, the first tabs 94 and the second tabs 96 define respective collar elements, with adjustable size, to firmly hold respective portions of the at least one bottle 2 in engagement along the support 4.

According to a preferred embodiment, the angle defined between the at least one first inclined plane 91 and the second inclined plane 92 is equal to 90° or about 90°.

It should be noted that the angle delimited between the first inclined plane 91 and the second inclined plane 92 can assume different values with respect to 90° to adjust the dimensions of the support 4, and in particular its extension along a direction normal to the base 71, as a function of the height of the at least one bottle 2 to be retained (i.e. as a function of the size of the at least one bottle 2 along the direction normal to the base 71).

The top portion 8 is shaped in a similar way to the base portion 7 and is configured to firmly hold and repair the head portion of at least one bottle 2 inside the support 4.

The top portion 8 is configured as a box-like element delimited between a first top wall 81, a flat top 82, a second top wall 83, a flat top element 84 which develop one after the other and they are folded together to delimit a box-like body open at opposite ends.

The top portion 8 may include a third top wall 85 which protrudes normally to the top flat element 84, on the opposite side to that connected to the second top wall 83.

The third top wall 85, if present, performs the same function for the top flat element 84 as the third wall 75 of the base portion 7 in relation to the flat retaining element 74.

In this regard, it should be noted that the top portion 8 can comprise at least a tab or a similar element, not illustrated in detail in the attached figures, configured to engage a respective seat made along the second top wall 83, and be retained therein, to mutually connect the third wall 85 and the second top wall 83, constraining in position the flat top element 84 relative to the top 81.

If the third wall 85 is not present, the top portion 8 can comprise at least one tab which protrudes from the top flat element 84, on the opposite side to that connected to the second wall 83 and configured to engage a respective opening made along the first top wall 81, thus keeping the flat top element 84 in position.

In the top portion 8, it is noted that the top flat element 84 is aligned parallel to the flat top 82, optionally aligned inclined according to the extension of the first top wall 81 and of the second top wall 83 along a direction normal to the flat top 82, similarly to what previously described for the base portion 7.

The top flat element 84 defines at least one through hole 86 engageable by the head of at least one bottle 2 held along the support 4.

In practice, by engaging the head of the bottle 2 through the through hole 86, the top portion 8 is constrained to the bottle 2 itself.

The top portion 8 comprises a plurality of fins 87 which protrude radially from the through hole 86 acting as a retaining collar for the neck or head of the at least one bottle 2 in engagement along the support 4.

With reference to the embodiment illustrated in the attached FIGS. 1 to 3, 8 and 9, the package 1 comprises first lateral reinforcing elements and second lateral reinforcing elements, configured as flat elements connected to opposite sides of the support 4, for reinforce it, as will be better described below.

With reference to what is illustrated in the attached FIG. 8, the package 1 comprises a first lower reinforcement element 10 which starts from one side of the first inclined plane 91 and is configured to be selectively connected to the base 7 of the support 4. In particular, the first lower reinforcement element 10 has a free end, opposite the end connected to the first inclined plane 91, configured to be selectively connected to a respective portion of the base 7.

It is pointed out that the first lower reinforcement element 10 is configured to be bent with respect to the first inclined plane 91, in correspondence with its connection with the first inclined plane 91 itself.

The first lower reinforcement element 10 provides a connection element between the first inclined plane 91 and the base portion 7, stiffening the support 4 and giving it greater stability.

The packaging 1 also includes a first upper reinforcement element 110 which protrudes from one side of the second inclined plane 92 and is configured to be selectively connected to the top portion 8, fulfilling the same purposes as the first lower reinforcement element 10.

The first upper reinforcement element 110 is configured to be folded relative to the second inclined plane 92, so as to connect it to the top portion 8 of the support 4.

The first lower reinforcement element 10 and the first upper reinforcement element 110 are both positioned along the same side of the support 4 (see FIG. 1).

The packaging 1 comprises a second lower reinforcement element 11 which starts from one side of the first inclined plane 91, in the opposite position to that of the first lower reinforcement element 10, and is configured to be selectively connected with the base 7 of the support 4. In fact, the second lower reinforcement element 11 provides a further connection element between the first inclined plane 91 and the base portion 7, stiffening the support 4 and giving it greater stability.

The packaging 1 comprises a second upper reinforcement element 111 which protrudes from one side of the second inclined plane 92, opposite to that from which the first upper reinforcement element 110 protrudes, and is configured to be selectively connected to the top portion 8, fulfilling the same purposes as the second lower reinforcement element 11.

The second lower reinforcement element 11 and the second upper reinforcement element 111 are both positioned along the same side of the support 4 which, as mentioned, is opposite to the one along which the first lower reinforcement element 10 and upper 110 are positioned.

The first lower reinforcement element 10, the first upper reinforcement element 110, the second lower reinforcement element 11 and the second upper reinforcement element 111 are made starting from the same plate with which the support 4 is made, thus facilitating production and the assembly of the support 4 itself.

The first lower reinforcement element 10, the first upper reinforcement element 110, the second lower reinforcement element 11 and the second upper reinforcement element 111 stiffen the support at the first inclined plane 91 and the second inclined plane 92, avoiding their collapse during the insertion of at least one bottle 2 along the support 4.

In the attached FIGS. 1 to 3, the first lower reinforcement element 10, the first upper reinforcement element 110, the second lower reinforcement element 11 and the second upper reinforcement element 111 are shown separated by the first inclined plane 91 and the second inclined plane 92 for a better understanding of the structure of the support 4.

The first lower reinforcement element 10 and the second lower reinforcement element 11 each have a base portion that can be removably connected to respective sides of the base portion 7 of the support 4, which are opposite to each other.

Similarly, the first upper reinforcement element 110 and the second upper reinforcement element 111 each have a top portion that can be removably connected to respective sides of the top portion 8 of the support 4, which are opposite to each other.

According to a preferred embodiment, the first lower reinforcement element 10 has, in correspondence with one of its base portion, a first seat 12 which can be removably engaged from a first protrusion 13 which departs laterally from the base portion 7 of the support 4.

The first seat 12 extends through the first lower reinforcement element 10.

Preferably, the first protrusion 13 departs from the retaining element 74. The engagement can take place through interlocking or coupling of shape.

The first upper reinforcement element 110 can have, in correspondence with one of its top portion, a second seat 14 engageable by a second protrusion 15 which, optionally, laterally protrudes from one side of the top portion 8 and, more precisely, from the same side from which the first projection extends 13.

The second seat 14 is made passing through the first upper reinforcement element 110.

Preferably, the second protrusion 15, if present, departs from the top flat element 84. The engagement can take place through interlocking or coupling of shape.

Similarly to what has been described in relation to the first lower reinforcement element 10, the second lower reinforcement element 11 has a base portion which can be removably connected to a second side of the base portion 7 of the support 4. The second reinforcement element top 111 may in turn have a top portion that can be removably connected to a second side of the top portion 8 of the support 4.

It is observed that the second side of the base portion 7 and the second side of the top portion 8 face from the same second side of the support 4, opposite to the first side previously described.

In particular, the second lower reinforcement element 11 has a respective first seat 18, provided at a bottom portion thereof, engageable by a respective first protrusion 20 which protrudes from the second side of the base portion 7.

The respective first seat 18 is made passing through the second lower reinforcement element 11.

The second upper reinforcement element 111 may have a respective second seat 19 at its top portion, configured to be engaged, optionally, by a respective second protrusion 21 which extends laterally from the second side of the top portion 8 of the support 4.

The respective second seat 19 is made passing through the second upper reinforcement element 111.

In particular, it is emphasized that the respective first projection 20, if present, protrudes from the base portion 7 from the opposite side (second side of the support 4) with respect to that from which the first projection 13 protrudes (first side of the support 4) and, similarly, the respective second protrusion 21 protrudes from the top portion 8 from the opposite side (second side of the support 4) with respect to that from which the second protrusion 15 starts (first side of the support 4).

The support 4 therefore defines a structure capable of firmly retaining at least one bottle 2, keeping it in position thanks to the presence of several holding points.

The packaging 1 according to the invention is thus able to achieve the intended purposes, providing a stable support for at least one bottle 2 along the support 4 and a high protection for the same from impacts, being able to house the support 4 and the at least a bottle 2 connected to it inside the container 3, 30.

It is then highlighted how the support 4 allows a view of the at least one bottle 2, once engaged inside it, thanks to the presence of the at least one first inclined plane 91 and of the at least one second inclined plane 92 which in fact do not hinder the viewing of the at least one bottle 2 along the support 4.

It is also emphasized that the support 4 is configured to couple by means of a shape coupling with the compartment delimited in the container 3, 30 so as to be firmly retained inside it and to avoid movements of the at least one bottle 2 with respect to the package 1, during transport.

Further embodiments of the support 4 will be described below. The description of these embodiments will be limited to the distinctive features with respect to the other embodiments in order not to excessively burden the exposure. Therefore, characteristics present and shared in several embodiments will be described limitedly to only one of them, to which reference will be made later.

Figure 4:
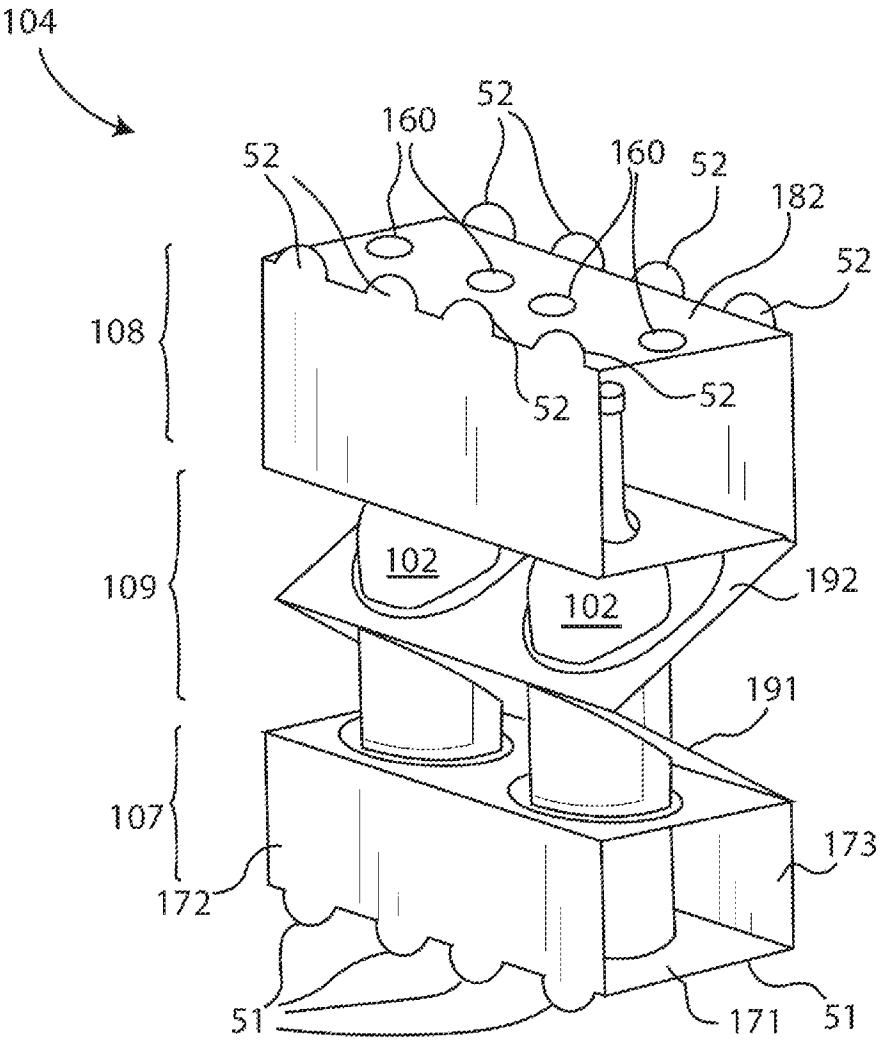

The attached FIG. 4 illustrates a further embodiment of a support 104 for a packaging 1.

In the following, the same reference numbers increased by 100 units will be used to indicate the same elements corresponding to those described for the previous embodiment.

The support 104 differs from the previous embodiment of the support 4 due to the presence of bottom spacer elements 51 which protrudes from the base portion 107 and, more precisely, from the base 171.

Preferably, the bottom spacer elements 51 extend perpendicular to the base 171, from opposite sides thereof, at the first wall 172 and the second wall 173.

The bottom spacer elements 51 allow to keep the base 171 raised with respect to the inside of the container 3 wherein the support 104 is inserted together with at least one bottle 102.

In this way, an additional protective element is provided for the base of the at least one bottle 2 contained within the packaging 1.

The bottom spacer elements 51 can be made as tabs cut from the base 171 and then bent by about 90° with respect to the latter, as part of a solution easy and practical to be used.

Similarly, the support 104 comprises, at the top portion 108, top spacer elements 52 which project orthogonally from the flat top 182 to distance the latter from the internal top of the container wherein the support 104 is configured to be housed.

The top spacer elements 52 can be made in the same way as described in relation to the bottom spacer elements 51, to which reference is made.

The flat top 182 has top openings 160 to facilitate gripping of the top of the support 104.

The support 104 comprises a central portion 109 similar to that described for the previous embodiment, comprising a first inclined plane 191 and a second inclined plane 192 in succession to each other.

The attached FIG. 4 illustrates a support 104 configured to house two bottles 102 although it is understood that further versions are possible configured to house a single bottle 102 or a greater number of bottles 102, for example three, four, etc., in a position side by side.

Figure 5:
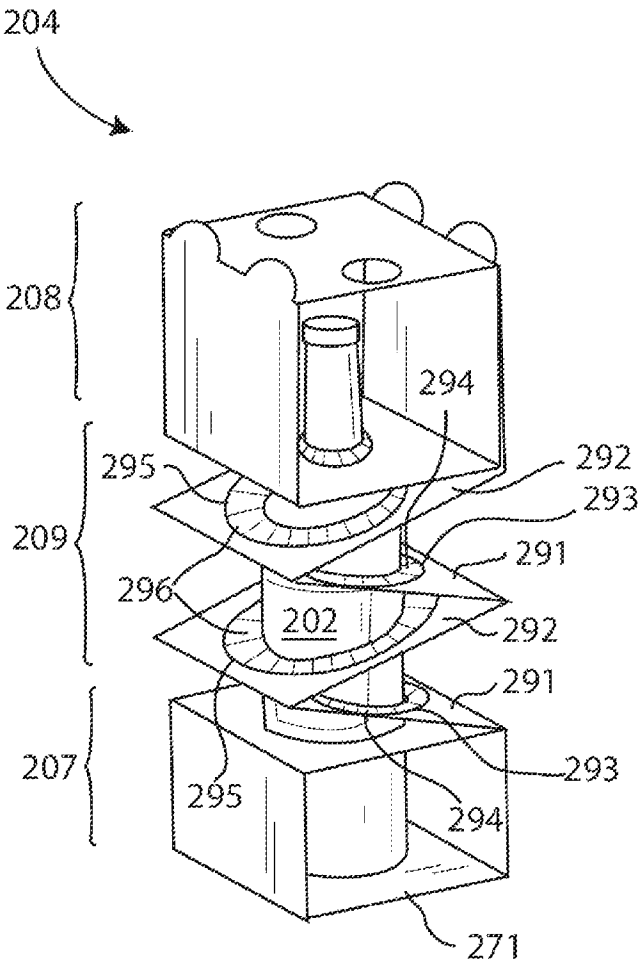

With reference to the attached FIG. 5, a further embodiment of a support 204 for at least one bottle 202 to be housed inside a transport container 3, 30 is illustrated.

The support 204 differs from the previous embodiments in relation to the number of inclined planes included along the central portion 209.

The support 204, in fact, has a base portion 207, a top portion 208 and a central portion 209 for connection between the base portion 207 and the top portion 208.

The central portion 209 comprises inclined first planes 291 alternating in succession with second inclined planes 292. The first inclined planes 291 and the second inclined planes 292 are mutually connected to form a "zeta" or "repeated zeta" structure.

The attached FIG. 5 illustrates, by way of non-limiting example, two first inclined planes 291 alternating with two second inclined planes 292, although it is understood that further versions are possible including a different number of first and second inclined planes 291, 292.

The first inclined planes 291 have an inclination opposite to that of the second inclined planes 292 similarly to what has been described in relation to the previous embodiments, to which reference should be made.

Each of the first inclined planes 291 and the second inclined planes 292 delimits a respective through opening, bearing fins which protrude radially inside each respective through opening, for housing and holding the central portion of at least one engaged bottle 202 along the support 204, according to the same methods described in relation to the previous embodiments.

In particular, each of the first inclined planes 291 delimits an opening 293, bearing first fins 294 and each of the second inclined planes 292 defines a second opening 295 from which second fins 296 radially protrudes for the same purposes previously described.

It is limited to highlighting how each of the first openings 293 and of the second openings 295 passing respectively through the first inclined planes 291 and the second inclined planes 292 are aligned with each other in a direction normal to the base 271 of the base portion 207, to allow the insertion of at least one bottle 202 along the support 204.

The base portion 207 and the top portion 208 illustrated in the attached FIG. 5 have the same features described in relation to the previous embodiment illustrated in the annexed FIG. 4 (i.e. in relation to the base portion 107 and the top portion 108) to which we refer. It is understood that the base portion 207 and the top 208 can assume the same configuration described in relation to the base portion 7 and the top portion 8 of the first embodiment (see FIGS. 1 to 3).

Figure 6:
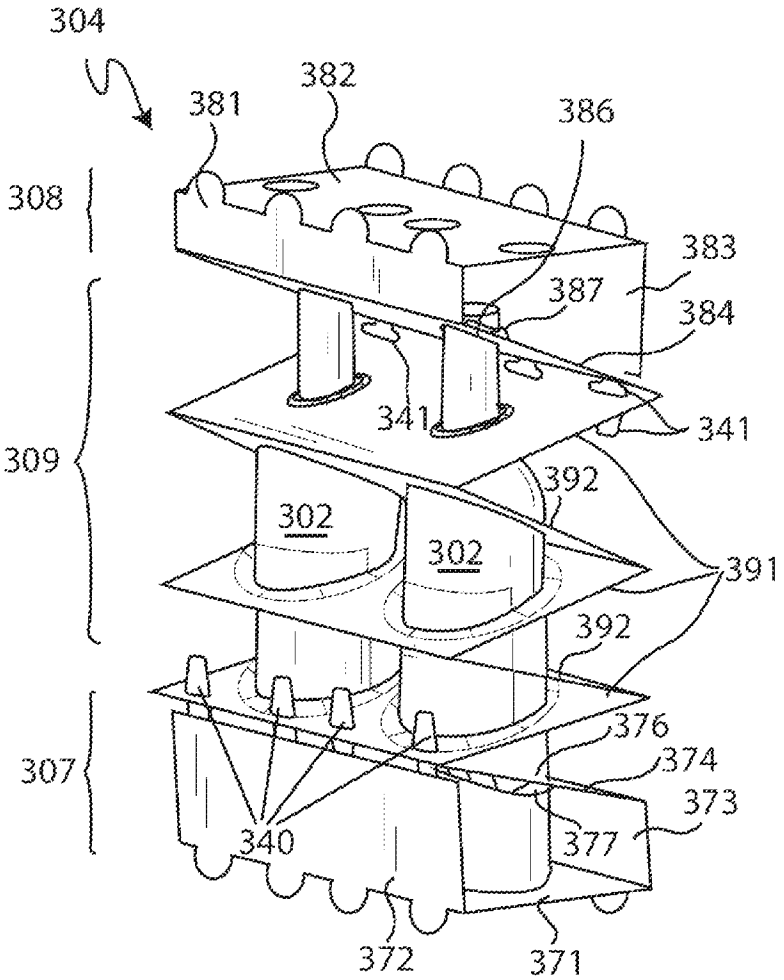

A further embodiment of a support 304 for at least one bottle 302 is shown in the attached FIG. 6. Specifically, the support 304 as illustrated is configured to house two bottles 302, although it is understood that further configurations of the support 304 itself are possible for a different number of bottles 302.

The support 304 differs from the previous embodiments in relation to the configuration of the base portion 307 and the top portion 308.

The base portion 307 and the top portion 308 are each substantially configured as a box-like body open at the opposite ends but, with respect to what is described in relation to the support 4, has a different number of walls bent relatively to each other.

In particular, the base portion 307 comprises a base 371 at the opposite ends of which a first wall 372 or front wall and a second wall 373 or rear wall project orthogonally, thus assuming a "U" or substantially "U" configuration.

The base portion 307 also includes a flat retaining element 374 which protrudes from the second wall 373, from the opposite end to that connected to the base 371.

Similarly to what has been described for the flat retaining element 74, also the flat retaining element 374 has at least one through opening 376 engageable by the bottom portion of at least one bottle 302, wherein the at least one through opening 376 has a plurality of fins 377 extending in a radial direction to define a retaining collar for a bottom portion of at least one bottle 302.

It should be noted that according to this embodiment, the support 304 has retaining elements configured as shaped tabs 340 which protrude from the first wall 372, along a direction normal to the base 371, and engage respective openings made passing through the flat retaining element 374 and the first inclined plane 391.

In fact, the shaped tabs 340 keep the flat retaining element 374 in position, giving stability to the base portion 307.

The central portion 309 of the support 304 comprises five inclined planes which are connected in succession to each other so as to define an element with a "repeated zeta" pattern. Along the central portion 309, first inclined planes 391 can be identified, each alternating with a respective second inclined plane 392. More in detail, with reference to what is illustrated in FIG. 6, the support 304 comprises three first inclined planes 391 and two second inclined planes 392 alternating in succession with each other. The first inclined planes 391 have an inclination opposite to that of the second inclined planes 392.

It is understood that the central portion 309 may comprise a different number of inclined first planes 391 and inclined second planes 392 with respect to the above, even in the context of a solution that has a "zeta" or "repeated zeta" structure.

As far as the top portion 308 is concerned, it is shaped in a similar way to that described in relation to the base portion 307.

The top portion 308 is therefore shaped as a box-like element delimited between a first top wall 381, a flat top 382, a second top wall 383 which define a "U" or substantially "U" shaped element. The top portion 308 also includes a flat top element 384 that protrudes from the second top wall 383, from the opposite end to that connected to the flat top 382.

The flat top element 384 has at least one through hole 386 engageable by the head portion of at least one bottle 302, wherein the at least one through hole 386 has a plurality of fins extending in a radial direction to define a retaining collar for the head or neck portion of at least one bottle 302.

The support 304 has further retaining elements configured to keep the top flat element 384 in position. These retaining elements are shaped like further shaped tabs 341 which protrude from the second top wall 383, along a direction normal to the flat top 382, and engage respective openings made passing through the flat top element 384 and one between the first plane inclined 391 or the second inclined plane 392 which is connected to the top flat element 384.

This embodiment of the support 304 however allows to pursue the same advantages achieved by the previous embodiments with reference to the ability to firmly hold at least one bottle 302 in position, protecting it from possible impacts, while ensuring the possibility of seeing and appreciating the aesthetics of the at least one bottle 302 through the openings present between a first inclined plane 391 and a second inclined plane 392.

Figure 7:
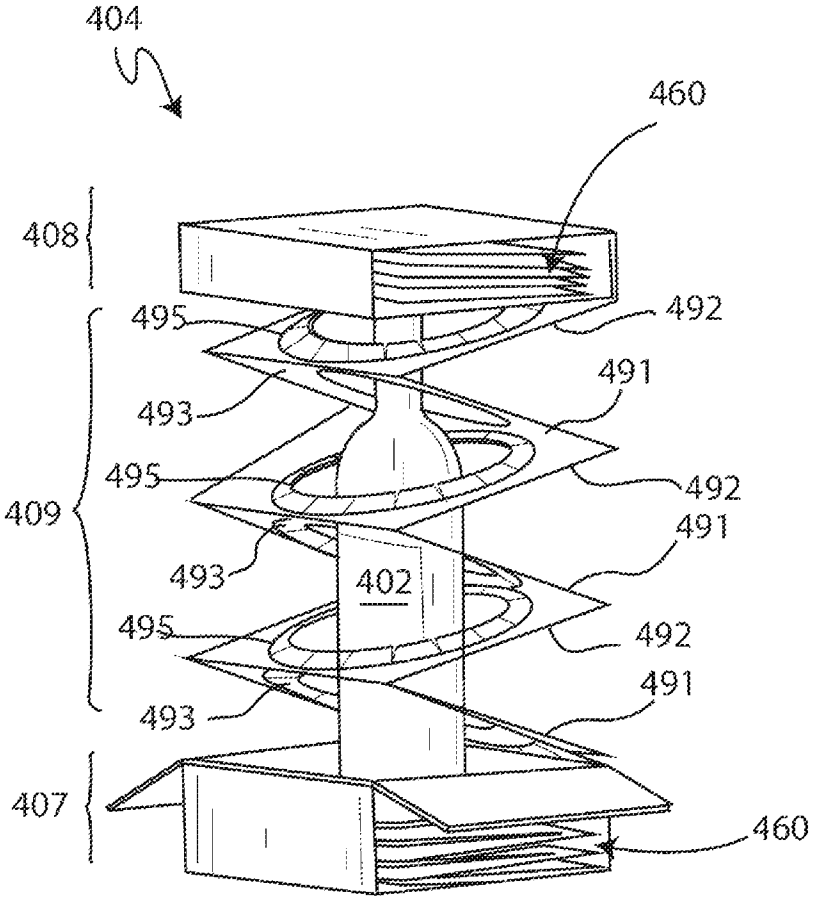

With reference to the attached FIG. 7, a further embodiment of the support is illustrated which will be indicated as a whole with 404.

The support 404 comprises a base portion 407, a top portion 408 and a central portion 409 for connection between the base portion 407 and the top portion 408.

The base portion 407 and the top portion 408 each have a box-like conformation similar to that described in relation to the base portion 7 and the top portion 8 while the central portion 409 has a plurality of inclined first planes 491 and second planes 492 inclined alternating between them to define a "zeta" or "repeated zeta" structure.

The base portion 407 comprises at least one dampening device 460 arranged inside it and provided in an interposed position between the base 471 and the bottom of at least one bottle 402 retained in the support 404.

The dampening element 460 is configured to reduce the stresses that can be transmitted to the bottom of at least one bottle 402 retained in the support 404 during its transport.

Preferably, the damping element 460 is made as a plurality of sheets stacked in succession to each other to define a "zeta" or "repeated zeta" structure (see FIG. 7).

In particular, the shock-absorbing element 460 can be connected directly to at least one of the walls that delimit the base portion 407 or it can be made starting from an element separated from the support 404, modelled and then inserted in correspondence with the base portion 407 (see FIG. 7).

By way of non-limiting example, the dampening element 460 can be made starting from a sheet or a plate-like element, folded back on itself to define an accordion-like structure or more generally a structure comprising several inclined planes connected in succession to each other.

According to an alternative, not illustrated in the attached figures, the dampening element 460 is made as a sheet-like bearing made of a material capable of absorbing shocks such as a polymer, a foam material or a similar element suitable for the purpose known in the field.

The top portion 408 can also comprise a dampening element 460 inside, similarly to what is described above. It can be observed that in the attached FIG. 7 the dimensions of the first openings 493, passing through respective first inclined planes 491 and of the second openings 495, passing through respective second inclined planes 492, have been enlarged excessively for their better intelligibility, although it is intended that said first openings 493 and second openings 495 bear respective fins for abutment and firmly retaining the bottle 402 passing through them.

In the attached FIGS. 10 and 11, and partly in FIG. 8, a further version of a shock-absorbing device indicated as a whole with 560 is illustrated.

The shock-absorbing device 560 comprises at least one support tab 561 obtained from a wall of the base portion 507 of the support 504, for example the first wall 572 or the second wall 573 (see FIGS. 10 and 11 and FIG. 8 in which a support tab 561).

The at least one support tab 561 is configured to be foldable with respect to the wall of the base portion 507 so as to be able to protrude inside the base portion 507 itself.

In particular, it is highlighted how the at least one support tab 561 is made in a spaced position with respect to the base 571 of the base portion 507, so as not to meet against it during its use.

The at least one support tab 561, in fact, is configured to extend inside the base portion 507 with a distance such as to appear inside the plan dimensions of the bottle 502 which can be engaged in the support 504. In practice, the at least one support tab 561 acts as a deformable support for the bottom of the bottle 502 housed in the support 504 (see FIG. 11), effectively acting as a deformable dampening element.

The attached FIGS. 10 and 11 illustrate a support 504 comprising two support tabs 561 each made along a respective wall that delimits the base portion 507 of the support 504, from opposite sides.

According to this version, the two support tabs 561 are sized in such a way that they do not meet each other when they are bent relative to the respective walls from which they depart, facing inside the base portion 507, thus providing a stable and balanced support for the at least one bottle 502 held in holder 504.

It should be noted that the damping device 560, although it has been illustrated limitedly to the support 504, really, can be integrated in any of the embodiments of the support 4, 104, 204, 304, 404 previously described, to supplement it or alternative to a possibly provided damping device 460.

With reference to the attached FIG. 9, a further embodiment of the support is illustrated which will be indicated as a whole with 604.

The support 604 comprises a base portion 607, a top portion 608 and a central portion 609 for connection between the base portion 607 and the top portion 608.

The base portion 607 and the top portion 608 each have a box-like conformation similar to that described in relation to the base portion 7 and the top portion 8 while the central portion 609 has a first inclined plane 691 and a second inclined plane 692 mutually connected via a central wall 693.

The support 604 has a first lower reinforcement element, a first upper reinforcement element, a second lower reinforcement element 611 and a second upper reinforcement element 612 configured in a similar way to the corresponding components described in relation to the support 4, for the same purposes, to which reference is made.

Compared to what is illustrated and described in relation to the support 4, the support 604 has a central portion 609 substantially devoid of lateral containment walls, to facilitate greater visibility of the at least one bottle 602 housed in the support 604 itself.

The attached FIGS. 12-14 illustrate a further embodiment of a support according to the invention, indicated as a whole with 704, configured to support a single bottle 702, although it is intended that it can be configured for supporting several bottles 702 according to the same methods described for the previous embodiments.

The support 704 differs from the previous embodiments in relation to the configuration of the central portion 709 which comprises a single inclined plane 791 connecting a base portion 707 and a top portion 708.

The inclined plane 791 fulfils the same purposes described in relation to the previous embodiments, to which reference is made in its entirety, differing exclusively in the characteristic of acting as a connecting element between the base portion 707 and the top portion 708.

The base portion 707 and the top portion 708 are configured according to the same methods described in relation to the previous embodiments to which reference is made in its entirety.

Hereinafter, the base portion 707 and the top portion 708 will be described limitedly to those features useful for understanding the configuration of the support 704.

The base portion 707 is delimited between a base 771, a first wall 772 which extends orthogonally from the base 771, a second wall 773 which extends orthogonally from the base 771, on the opposite side with respect to the first wall 772, a retaining element 774 plane or abutment that extends from the first wall 772 and is spaced from the base 771.

The base portion 707 also includes a third wall 775 which protrudes orthogonally from the retaining element 774 itself, on the opposite side to that of the first wall 772 (see FIG. 14).

The base portion 707 is obtained by bending relative to each other, by 90° or substantially 90°, the third wall 775 with respect to the retaining element 774, then bending the first wall 772, the base portion 771 and, therefore, the second wall 773 so as to define a box-like element.

The flat retaining element 774 defines at least one through opening 776 which can be engaged by a bottom portion of the at least one bottle 702 to hold it in position.

The top portion 708 comprises a first top wall 781, a flat top 782, a second top wall 783, a flat top element 784 which extend one in succession to the other and are folded together to delimit an open box-like body with opposite ends to those in correspondence of which the first top wall 781 and the second top wall 783 extend.

The top portion 708 also comprises a third top wall 785 which extends from the top plane element 784, and is oriented orthogonal or substantially orthogonal with respect to the latter, on the opposite side with respect to that to which the second wall top 783 is connected.

In use, the third top wall 785 is leaning against the first top wall 781, within the latter, i.e. against the surface of the first top wall 781 which faces the inside of the top portion 708.

The inclined plane 791 connects the second wall 773 of the base portion 707 with the first top wall 781 of the top portion 708 (see FIG. 14).

The top portion 707, according to a preferred embodiment, has the first top wall 781 longer or extended than the second top wall 783, although it is understood that alternative embodiments include a first top wall 781 and a second wall top 783 which have the same length.

The term "length" in reference to the extension of the first top wall 781 and the second top wall 783 is intended to indicate an orthogonal or substantially orthogonal oriented separation distance to the top 782 and to the top plane element 784.

The support 704 illustrated in FIGS. 12-14 includes at least one top damping device 750 made at the top portion 708.

It is understood that the at least one top damping device 750 may in any case be present in the top portion 108, 208, 308, 408, 508, 608 of any embodiments of the support 104, 204, 304, 404, 504, 604.

The at least one top dampening device 750 comprises at least one top tab 755 made from a wall of the top portion 708 of the support 704, that is, from the first wall 782 or from the second wall 783.

In the attached FIGS. 12-14, the at least one top tab 755 departs from the second top wall 783.

The at least one top tab 755 is configured to be foldable with respect to the top wall 783 from which it is made, so as to be able to protrude inside the top portion 708 itself.

In particular, it can be seen that the at least one top tab 755 is configured to be folded towards a through hole 786 delimited through the top flat element 782, through which, in use, a portion of the neck of the bottle 702 (see FIGS. 12 and 14).

The at least one top tab 755 is configured to extend inside the top portion 708 with a distance such as to be close to the neck or the upper end of the bottle 702 engaged in the support 704.

The at least one top tab 755 is configured to act as an abutment and stiffening element for the flat top element 784 in correspondence with the at least one through hole 786 with particular reference to the case wherein the support 704 is positioned upside down, i.e. with the base portion 707 positioned above the top portion 708.

In particular, the at least one top tab 755 acts substantially as a support beam, keeping the bottle 702 firmly in position with the support 704 in an upside-down position, preventing the at least one bottle 702 itself from advancing inside the top portion 708 and hitting the top 782, damaging itself.

Preferably, the at least one top damping device 750 comprises at least one further top tab 756 which extends from the other between the second top wall 783 and the first top wall 781 and is inclined within the top 708 similarly to the at least one top tab 755.

With reference to what is illustrated in the attached FIGS. 12-14, the at least one further top tab 756 is made along the first top wall 781.

The at least one further top tab 756 extends through at least one opening delimited along the third top wall 783 to reach the at least one through hole 786, on the opposite side to that wherein the at least one is positioned top tab 755.

In practice, the at least one top tab 755 and the at least one further top tab 756 are positioned opposite each other and both converging towards at least one through hole 786.

The at least one further top tab 756 serves the same purposes described in relation to at least one top tab 755.

Furthermore, the at least one further top tab 756 is configured to lock the third wall 785 in position against the first wall 781, inside the top portion 708, ensuring high stability to the top portion 708 itself.

The number of top tabs 755 and additional top tabs 756 is equal to the number of bottles 702 that the holder 704 can hold.

The support 704 comprises bottom spacer elements 751 which protrude orthogonally with respect to the base portion 707 and, more precisely, from the base 771 and perform the same function as the spacer elements 151 previously described to which reference is made.

In addition, the support 704 includes, at the top portion 708, top spacer elements 752 which extend orthogonally with respect to the flat top 782 to distance the latter from the internal top of the container wherein the support 704 is configured to be housed.

The top spacer elements 752 perform the same purposes described in relation to the spacer elements 152 to which reference is made in full.

It should be noted that the support 704 can also comprise at least one shock-absorbing device 560 described in relation to the previous embodiments, to which reference is made. In this regard, the supporting tabs 561 have been illustrated in the attached FIGS. 13 and 14.

It should be noted that in the attached FIGS. 4 to 14 alternative embodiments of the support 104, 204, 304, 404, 504, 604, 704 are shown, although it is understood that they are intended to be introduced inside a container 3, 30 similarly to what has been described in relation to the support 4 to form a package 1 according to the invention.

The packaging 1 is extremely practical in use as it can be easily adapted to the dimensions of various bottles, with reference to the size of the length, simply by varying the length of the central portion 9, 109, 209, 309, 409, 609, 709 intended as an extension along a direction normal to the base 71, 171, 271, 371, 771 by varying the relative inclination between the at least one first inclined plane 91, 191, 291, 391, 491, 691 and the at least one second inclined plane 92, 192, 292, 392, 492, 692 or in the case of the support 707 the length of the inclined plane 791.

Furthermore, the presence of numerous holding points of the at least one bottle 2, 102, 202, 302, 402, 502, 602, 702 along the support 4, 104, 204, 304, 404, 504, 604, 704 allows to keep firmly in the same position inside the packaging 1, ensuring its integrity during transport.

Furthermore, the presence of a shock-absorbing device 460, 560 and/or of at least a top shock-absorbing device 750 allows to preserve the integrity of the at least one bottle 2, 102, 202, 302, 402, 502, 602, 702 if the packaging 1 is accidentally subjected to impacts or overturning, for example following a fall or incorrect positioning.

In the foregoing, the preferred embodiments have been described and variants of the present invention have been suggested, but it is to be understood that those skilled in the art will be able to make modifications and changes without thereby departing from the relative scope of protection, as defined by the claims attached.

The invention claimed is:

1. A packaging for the transport of at least one bottle, comprising at least one container configured to define a compartment inside which to house and hold a support in turn configured to hold at least one bottle, wherein the support comprises a base portion, a top portion and a central portion for the connection between the base portion and the top portion, wherein the base portion and the top portion are each configured as a box-type body for receiving and retaining respective portions of the at least one bottle and wherein the central portion comprises one or more inclined planes configured to house and retain a central portion of the at least one bottle, wherein the support comprises at least one dampening device comprising at least one support tab provided in correspondence with the base portion in a spaced position with respect to the base of the base portion so that the at least one support tab does not abut against the base, wherein the at least one support tab is obtained from a wall of said base portion and the at least one support tab is foldable inside the base portion of the support to act as deformable support for a bottom portion of the at least one bottle.

2. The packaging according to claim 1, wherein the one or more inclined planes comprise or consist of at least a first inclined plane or in at least a first inclined plane and at least one second inclined plane connected to each other.

3. The packaging according to claim 2, wherein the support comprises a first lower reinforcement element which departs from one side of the first inclined plane and is configured to be selectively connected with the base portion, a first upper reinforcement element which departs from one side of the second inclined plane and is configured to be selectively connected with the top portion, wherein the first lower reinforcement element and the first upper reinforcement element are both positioned along the same side of the support.

4. The packaging according to claim 3, wherein the first lower reinforcement element delimits, at the base portion thereof, a first seat removably engageable by a first protrusion which is extends laterally from the first side of the base portion of the support.

5. The packaging according to claim 3, wherein the first lower reinforcement element delimits, at the base portion thereof, a first seat removably engageable by a first protrusion which is extends laterally from the first side of the base portion of the support, wherein the first upper reinforcement element delimits a second seat engageable by a second protrusion which laterally extends from the first side of the top portion of the support.

6. The packaging according to claim 1, wherein the base portion comprises a base, a first wall which orthogonally protrudes from the base, a second wall which extends orthogonally from the base, on the opposite side with respect to the first wall, a flat retaining element which protrudes from the second wall, on the opposite side to that connected to the base, wherein the flat retaining element delimits at least one through opening engageable by a portion of the bottom of the at least one bottle.

7. The packaging according to claim 1, wherein the top portion includes at least a first top wall, a flat top which protrudes orthogonally from the first top wall, a second top wall which protrudes orthogonally from the flat top on the opposite side to that side of the first top wall and a flat top element which protrudes transversely from the second top wall from the side opposite to that side of the flat top, wherein the top flat element delimits at least one through hole configured to be engaged by a head portion of the at least one bottle.

8. The packaging according to claim 7, wherein the support comprises a second lower reinforcement element which departs from one side of the first inclined plane, opposite to that side from which the first lower reinforcement element departs and is configured to be selectively connected with the top portion, a second upper reinforcement element which departs from one side of the second inclined plane, opposite to that side from which the first upper reinforcement element departs, and is configured to be selectively connected with the top portion.

9. The packaging according to claim 8, wherein the second lower reinforcement element delimits, at the base portion thereof, a respective first opening removably engageable by a respective first protrusion which laterally extends from a second side of the base portion.

10. The packaging according to claim 8, wherein the second lower reinforcement element delimits, at the base portion thereof, a respective first opening removably engageable by a respective first protrusion which laterally extends from a second side of the base portion, wherein the second upper reinforcement element delimits a respective second seat engageable by a respective second protrusion which extends laterally from the second side of the top portion of the support.

11. The packaging according to claim 1, wherein the support comprises bottom spacer elements which orthogonally depart from the base, at opposite sides, at the first wall and the second wall and are configured to abut against a bottom portion of the container when the support is inserted in the container, keeping the support raised from the bottom portion of the container.

12. The packaging according to claim 1, wherein the support comprises top spacer elements, at the top portion which orthogonally protrude from the flat top and are configured to distance the top portion from a top portion of the compartment of the container, with the support inserted in the container.

13. The packaging according to claim 1, wherein the support has retaining elements configured as shaped tabs which protrude from the first wall, along a direction normal to the base and engage respective openings made passing through the flat retaining element and the first inclined plane to hold the flat retaining element in position.

14. The packaging according to claim 1, wherein the support comprises further retaining elements configured to keep the top flat element in position, wherein the further retaining elements comprise further shaped tabs which protrude from the second top wall, along a normal direction to the flat top, and engage respective openings made passing through the top flat element and one between the first inclined plane or the second inclined plane which is connected to the top plane element.

15. The packaging according to claim 1, comprising at least one gripping handle which protrudes from a top portion of a closing cover through a through opening realised in the closing cover, wherein the at least one handle is configured to selectively assume a retracted position, wherein the at least one handle is retracted inside the closing cover or an extracted position wherein the at least one handle extends from a top portion of the closure cover.

16. The packaging according to claim 1, comprising at least one top dampening device provided at the top portion, wherein the at least one top dampening device comprises at least on top tad obtained from one among the first top wall and the second top wall, wherein the at least one top tab is configured to be foldable so as to protrude inside the top portion providing a free end thereof at the at least one passing though hole delimited through the top flat element, wherein the at least one passing through hole is configured to be engaged by a top portion of the at least one bottle engaged in the support.

17. The packaging according to claim 16, wherein the at least one top dampening device comprises at least one further top tab which extends from the other among the at least one second top wall and the first top wall from a position opposite to that of the at least on top tab, wherein the at least on top tab and the at least one further top tab are folded towards the inside of the top portion converging towards the at least one passing through hole.

* * * * *